US006665894B2

(12) United States Patent
Moffa et al.

(10) Patent No.: US 6,665,894 B2
(45) Date of Patent: Dec. 23, 2003

(54) CONTROL APPARATUS AND CONTROL METHOD FOR A STORABLE PATIENT LIFT AND TRANSFER DEVICE

(75) Inventors: Anthony Louis Moffa, Phoenixville, PA (US); Richard Howard Tuft, Wallingford, PA (US)

(73) Assignee: Millennium Medical Products, Inc., Broomall, PA (US)

( * ) Notice: Subject to any disclaimer, the term of this patent is extended or adjusted under 35 U.S.C. 154(b) by 0 days.

(21) Appl. No.: 10/141,503

(22) Filed: May 8, 2002

(65) Prior Publication Data

US 2003/0208844 A1 Nov. 13, 2003

(51) Int. Cl.[7] ..... A61G 7/10
(52) U.S. Cl. ..... 5/86.1; 5/424
(58) Field of Search ..... 5/86.1, 81.1 R, 5/424, 83.1

(56) References Cited

U.S. PATENT DOCUMENTS 5,560,054 A * 10/1996 Simon ..... 5/86.1
6,026,523 A * 2/2000 Simon et al. ..... 5/86.1

* cited by examiner

*Primary Examiner*—Alexander Grosz
(74) *Attorney, Agent, or Firm*—Reed Smith LLP

(57) ABSTRACT

A computerized controller that limits the movement of a patient lifting device, wherein the controller is operated in a normal mode to sense the lateral rotation of a lifting arm that lifts patients and the linear displacement of extendable support legs for said lifting device and the angular diversion of said support legs. The controller inhibits movement of said lateral rotation of a lifting arm in response to the linear displacement and the angular diversion of the support legs to prevent tipping the lifting device. The same controller may be operated in a bypass mode to override the normal mode wherein the patient lifting device may be operated during a setup and breakdown operation to permit construction and disassembly of the patient lifting device.

10 Claims, 6 Drawing Sheets

CONTROL APPARATUS AND CONTROL METHOD FOR A STORABLE PATIENT LIFT AND TRANSFER DEVICE

CROSS REFERENCE TO RELATED APPLICATIONS

N/A

BACKGROUND OF THE INVENTION

1. Field of the Invention

The invention relates to patient safety and controllers, and, more specifically, to a patient lifting apparatus and a controller that permits operation of a patient lifting mechanism within a specified safe range of operation.

2. Description of the Background

It is well known that persons confined to a bed due to illness, age, accident, or injury and so forth possess such limited mobility that movement or transfer is extremely difficult. Improper transfer can result in serious complications to the individual arid the care giver. For instance, the need to move a patient immediately after an operation may be necessary, yet is a dangerous proposition, as any movement of the body may undo a surgeon's most careful work. Just as important is the need to transfer a bed ridden person for bathing or exercise so as to facilitate recovery.

In a hospital setting, a transfer is typically performed by a number of hospital workers, in order to comfortably lift a patient from one position to another. If the transfer is made only by hand, the hospital personnel risk back injury. If the transfer utilizes too few personnel, or requires reaching in an awkward position, the personnel may risk body strain. Further, despite the number of personnel employed to assist in the transfer, the patient is susceptible to injury from anyone who touches or lifts incorrectly.

For these reasons, a number of devices have been developed for lifting and lowering of incapacitated persons from a position in a bed, chair, bath or the like, such as a patient lift device having a base frame having vertically oriented guideposts, wherein a carriage assembly moves along the guideposts in response to an operator applied control signal. An arm assembly projects over the person placed into a sling for lifting. Such a device may require sufficient size to accomplish the intended service, namely, lifting. In particular, the device may employ elongated legs and a boom that is necessary to lift a patient. This may prevent the device from being easily transferred or stored. The length of the components are necessary so that the apparatus can fit beneath a bed or chair, yet provide sufficient support during the lifting process.

Another example of a patient lift and transfer apparatus includes a unitary frame having a caster wheel equipped U-shaped horizontal disposed frame. Again, the legs of this apparatus are capable of being placed beneath a patient's bed providing sufficient support for the lifting device as well as the patient. However, no provision is made for storage or transportation of the apparatus.

Another apparatus is based upon electrical motors to provide assistance in patient movement, wherein the arm members telescope and then retract. This apparatus does not include the retraction of the arms for purposes of storage or transportation.

A lifting device having leg support structures in the form of telescoping leg assemblies capable of extension and divergence is stable and may provide a safe and effective means of lifting patients. An example of such a lifting device is provided in U.S. Pat. No. 6,026,523, incorporated herein by reference in its entirety. The lifting device of this patent meets the particular problems commonly found in hospitals and convalescent homes, wherein short term lifting capabilities are necessary. Unique to this lifting device is the ability to lift up to six hundred pounds, yet retract in size for purposes of transporting and storage. In operation, the support legs provide about a seventy eight inch stance when fully extended. In a retracted position, the support legs telescope together, leaving a frame footprint of approximately fifty two inches. The lifting device includes a miniature crane having a rotatable column with a lifting arm that can be raised and lowered at the upper end. The column is rotatably coupled to the portable base frame, and is operably attached to an electric motor driven linear actuator that enables independent and reversible rotation of the column, in order to facilitate placement of the end of the lifting arm above the patient's bed, in order to permit eventual transport of the patient away from the bed, such as by, for example, a chair, gurney, or wheelchair. An additional electric motor driven linear actuator may make raising and lowering of the lifting arm effortless.

The support legs may be further extended outwardly from the frame once the apparatus is positioned at the bedside. This feature allows for ease of movement to various sites, but allows for greater stability during use. Additionally, the support legs, which are normally parallel with respect to each other, are pivotally attached to the base frame and operatively associated with an additional electrically driven linear actuator. Operation of this actuator enables angular displacement of the leg assemblies, so as to cause divergence or convergence thereof. This feature provides a safe and efficient means to ensure the stability of the entire apparatus during a lifting procedure. Additionally, since the extension and divergence of the support legs is carried out beneath the bed, access to the bed and the patient is not hampered in any way.

Once the apparatus is in position, the unit can be easily secured by locking the frame mounted wheels. In an embodiment, the apparatus uses four wheels, two of which are lockable caster wheels similar to those found on stretchers, positioned at the rear of the support base. Two additional casters are affixed to the lower portion of the support legs at their outermost or distal end.

With the support legs in an extended and divergent position, an operator can maneuver the lifting arm over a patient's bed, wherein a hook device is available for attaching to a patient sling. The sling is placed beneath the patient so as to facilitate support during transfer. The combination of actuator and lifting arm is capable of lifting up to six hundred pounds. Through an angular range of motion of about 50–90 degrees along the vertical axis. The column is further able to rotate about its axis on the order of about +/−30 degrees from a starting position, e.g. perpendicular to the rear edge of the support base, in either a clockwise or counterclockwise direction. Angular rotation of the column is performed by use of an electric motor coupled to a linear actuator.

An operator of the lifting device controls operation by sending control signals to the controller that, in turn, forwards control signals to actuators to generate the movement of the lifting device in accordance with the control signal. However, the methodology used to provide the control signal from the operator, such as a hand-held control pad, having thereon a plurality of control buttons, such as extend, lift, right, left, up, down, and the like, may be, intentionally or unintentionally, misused by the operator. In such an instance, the lifting device may not operate properly or safely. For example, if a safe footprint of the lifting device is not set before attempting a lift and transfer of the patient, such as by a failure to extend the base, or a failure to sufficiently open the legs, the base may allow for tipping over of the lifting device, thereby possibly harming the patient or the operator. When the legs are completely open angularly, and when the legs are completely extended linearly, a safe footprint is set, thereby allowing for lift and transfer with no tipping.

Recommendations to the operator, such as in the form of extensive in-service training emphasizing proper setup, and/or instructions included with signage placed on the lifting device, can assist in insuring proper setup of the lifting device. However, such training or informational methodologies nonetheless allow for human error. Thus, an automated device and method is needed to completely insure proper setup of the lifting device.

SUMMARY OF THE INVENTION

A computerized controller that limits the movement of a patient lifting device, wherein the controller is operated in a normal mode to sense the lateral rotation of a lifting arm that lifts patients and the linear displacement of extendable support legs for said lifting device and the angular diversion of said support legs, is disclosed. The controller inhibits movement of said lateral rotation of a lifting arm in response to the linear displacement and the angular diversion of the support legs to prevent tipping the lifting device.

A computerized controller that limits the movement of a patient lifting device, in a normal mode of operation, whereby tipping of the lifting device is prevented, is also disclosed. The controller is operated in a bypass mode to override the normal mode wherein the patient lifting device may be operated during a setup and breakdown operation to permit construction and disassembly of the patient lifting device.

BRIEF DESCRIPTION OF THE DRAWINGS

Understanding of the present invention will be facilitated by consideration of the following detailed description of a preferred embodiment of the present invention, taken in conjunction with the accompanying drawings, in which like numerals refer to like parts and in which.

DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical patient-safety or lifting device. Those of ordinary skill in the art will recognize that other elements are desirable and/or required in order to implement the present invention. However, because such elements are well known in the art, and because they do not facilitate a better understanding of the present invention, a discussion of such elements is not provided herein. The disclosure hereinbelow is directed to all such variations and modifications to lifting and/or control devices for motor positioning as known, and as will be apparent, to those skilled in the art.

Figure 1:
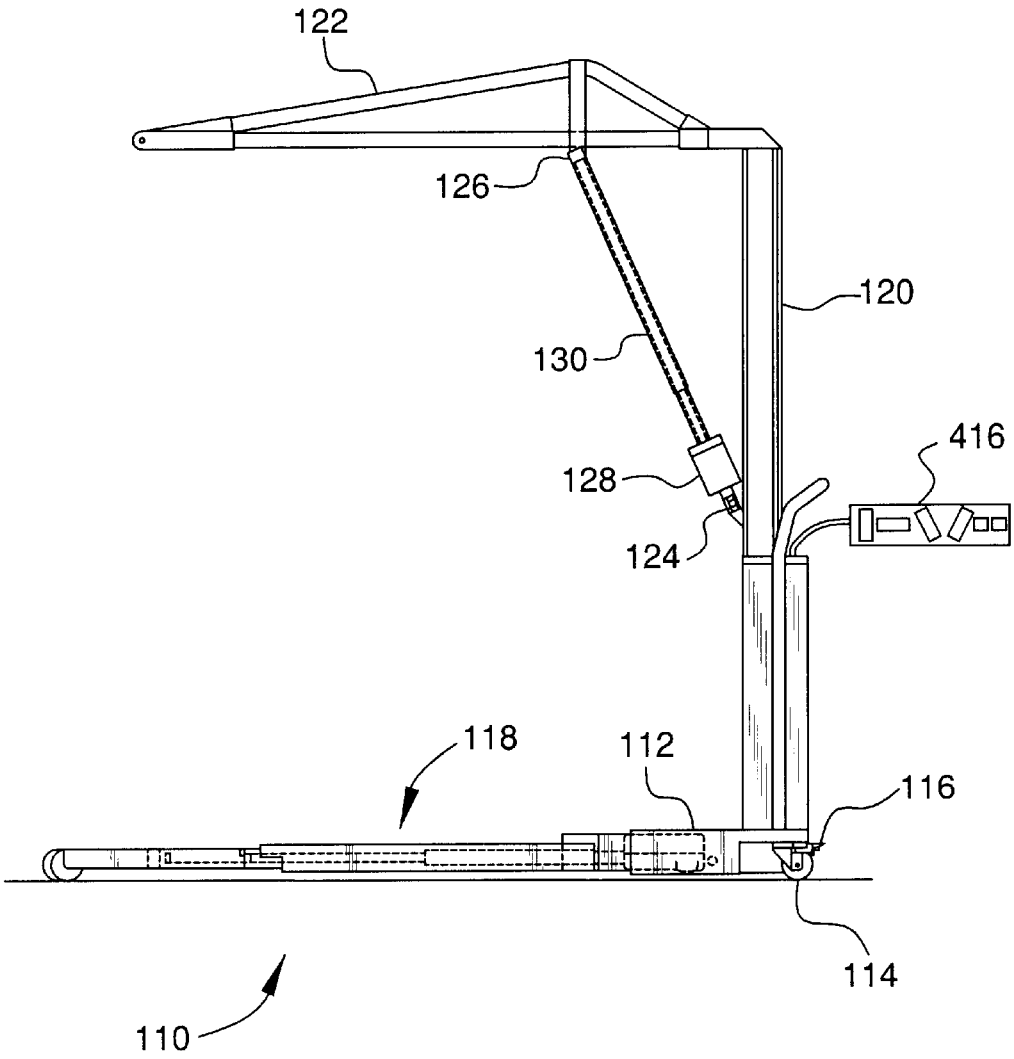
FIG. 1 is a side view of the lifting device with the support legs extended and the lift arm in a horizontal position.

Referring now to FIG. 1, shown is an embodiment of a lifting device 110, including a support base 112 having two locking rotatable casters 114 secured to the bottom of base 112.

Foot operated levers 116 may provide simplified engagement of wheel locks. Rotatable column 120 extends vertically from, and is mechanically linked to, support base 112 via column mount 314 (see FIG. 3). Lift arm assembly 122, shown in a horizontal orientation, may be pivotally attached to column 120 at first pivot point 124 and second pivot point 126. Extension of the lift arm from about 29 degrees above, to about 45 degrees below, the horizontal reference position shown may be accomplished by, for example, electric motor driven linear actuator 128. The actuator 128 acts a lifter, providing power to extend or retract actuator rod 130, thereby raising or lowering lift arm assembly 122 actuator rod 130.

Figure 2:
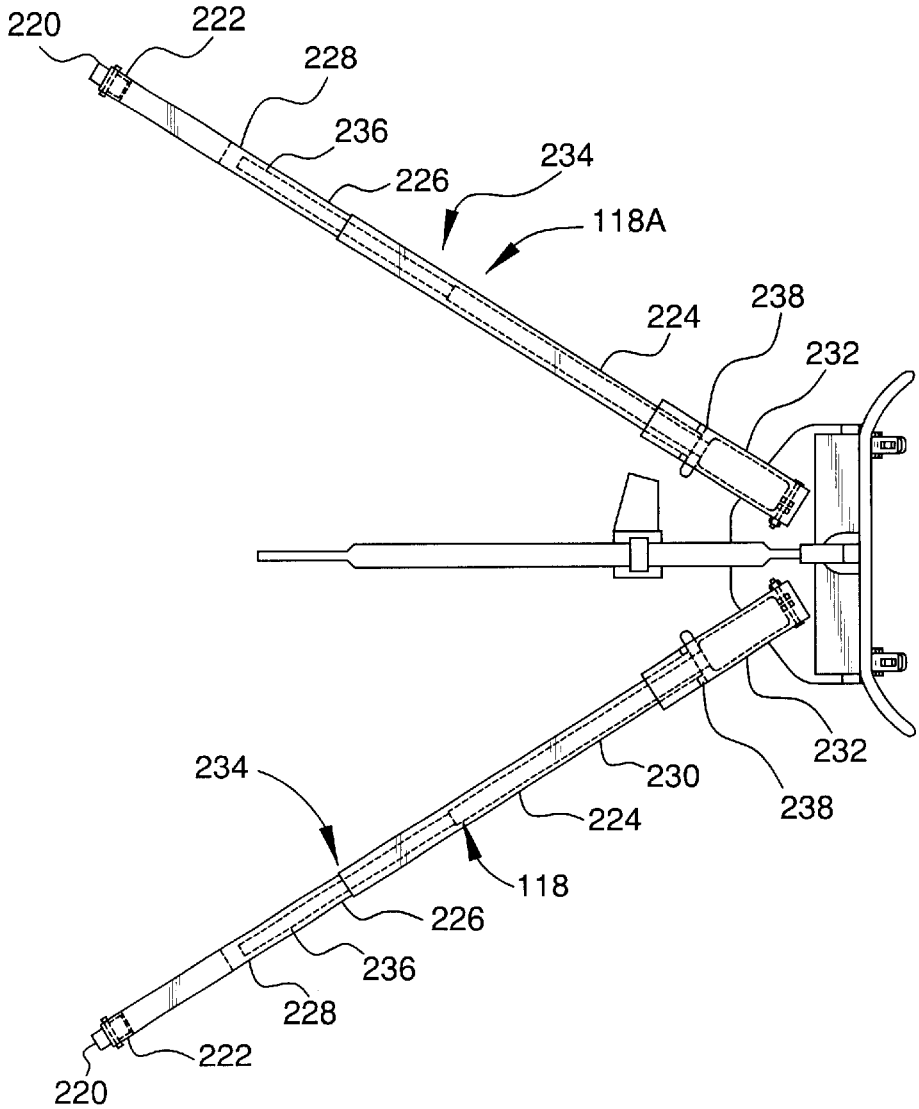
FIG. 2 is a top view of the lifting device with the support legs extended and diverged.

Referring now to FIG. 2, pivotally mounted to the support base 112 may be extensible legs 118 and 118A having a rotatable caster 220 mounted at a distal end 222 thereof. Each of the legs 118 and 118A may be formed of a leg weldment 224 and a leg extension 226 that together define a telescoping leg assembly 234 capable of reversible extension from the support base. The leg extension 226 may be in a nesting relation with the leg weldment 224, and may include a leg cylinder bracket 228 that is operatively associated with the distal end portion 236 of telescoping actuator rod 230. The proximal end 238 of the telescoping actuator rod is operatively associated with a linear actuator 232 for reversible extension of the leg assembly 234.

Figure 3:
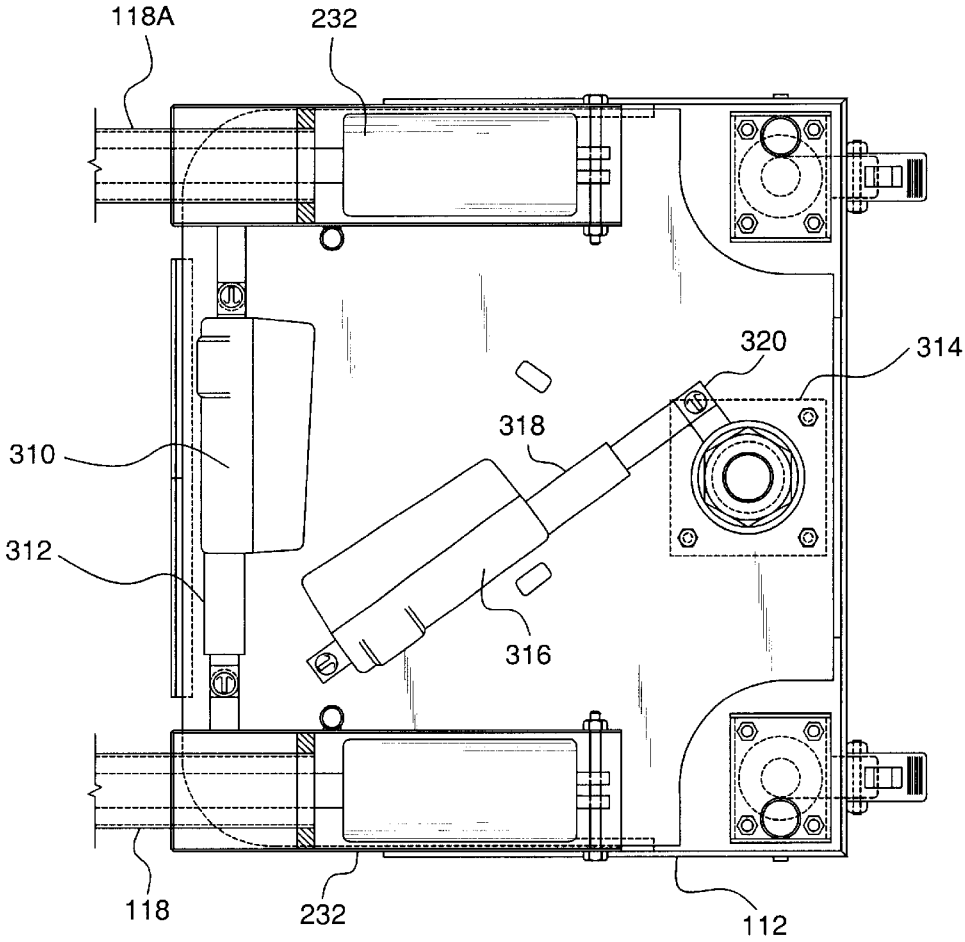
FIG. 3 is a cross-sectional top view of the support base.

Referring now to FIG. 3, a top cross-sectional view of support base 112 shows actuator motors 232 that each operate independently for extension of legs 118 and 118*a* as desired. An additional motor 310 may be mechanically linked to each of legs 118 and 118A. Activation of motor 310 causes actuator rod 312 to pivot the legs outwardly from the initial parallel orientation to a point where the legs circumscribe about a 40 degree to a 90 degree angle. The operator is thus able to reversibly extend each of legs 118, 118A independently, while causing the legs to reversibly diverge from one another. This allows the device to be easily transported from one patient area to another when in the compact retracted configuration.

Once in position at the patient's bedside, the legs may then be extended and diverged so as to define a longer and wider footprint, thereby providing enhanced stability during the patient lifting process. Column mount 314 retains the column in a vertical orientation with respect to the support base 112, while allowing the column to rotate about its axis. Electrically driven linear actuator 316 may act as a column 120 rotator that reversibly extends an actuator rod 318 that is pivotally attached to column 120 via an attachment arm 320. The column may, for example, have a total angular sweep of about +/−30 degrees to about +/−90 degrees to either side of a reference position wherein it is perpendicular to a plane defined by the handle 410 (see FIG. 4).

Figure 4:
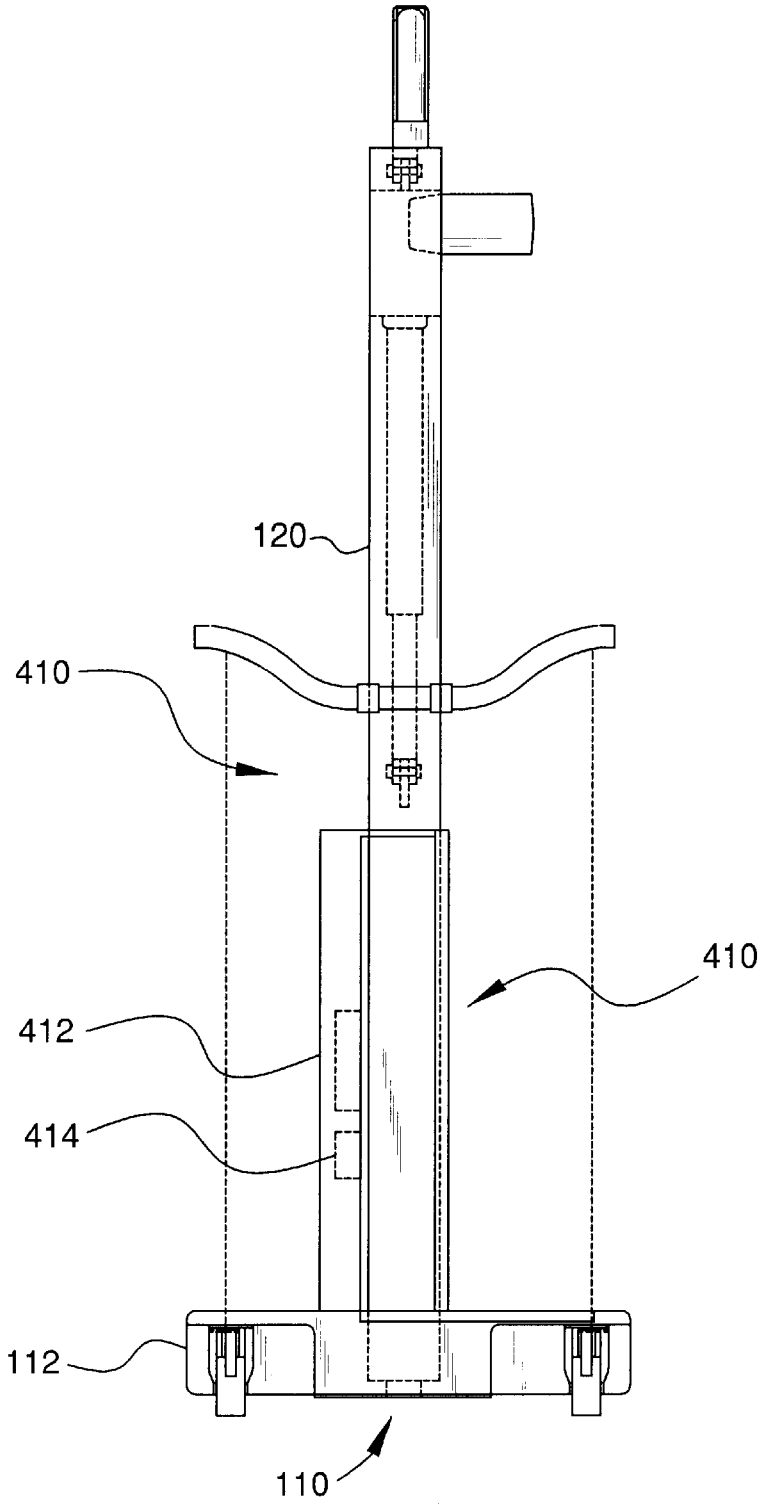
FIG. 4 is a back view of the device.

Referring now to FIG. 4, a back view of the device 110 shows U-shaped handle 410 that is attached to support base 112 and further attached to column 120 via a handle strap 414. The handle encloses a basket area 440 that may contain a controller 412 for transmitting signals to the various actuator motors, and a battery 414 for powering the various electrically controlled devices. A remote controller 416 may be provided in electrical communication with the control panel. The remote controller may contain the necessary switching devices to control up and down movement of the lining arm, clockwise and counterclockwise rotation of the column, extension and retraction of each of the legs individually, and divergence and convergence of both legs simultaneously, for example.

Figure 5:
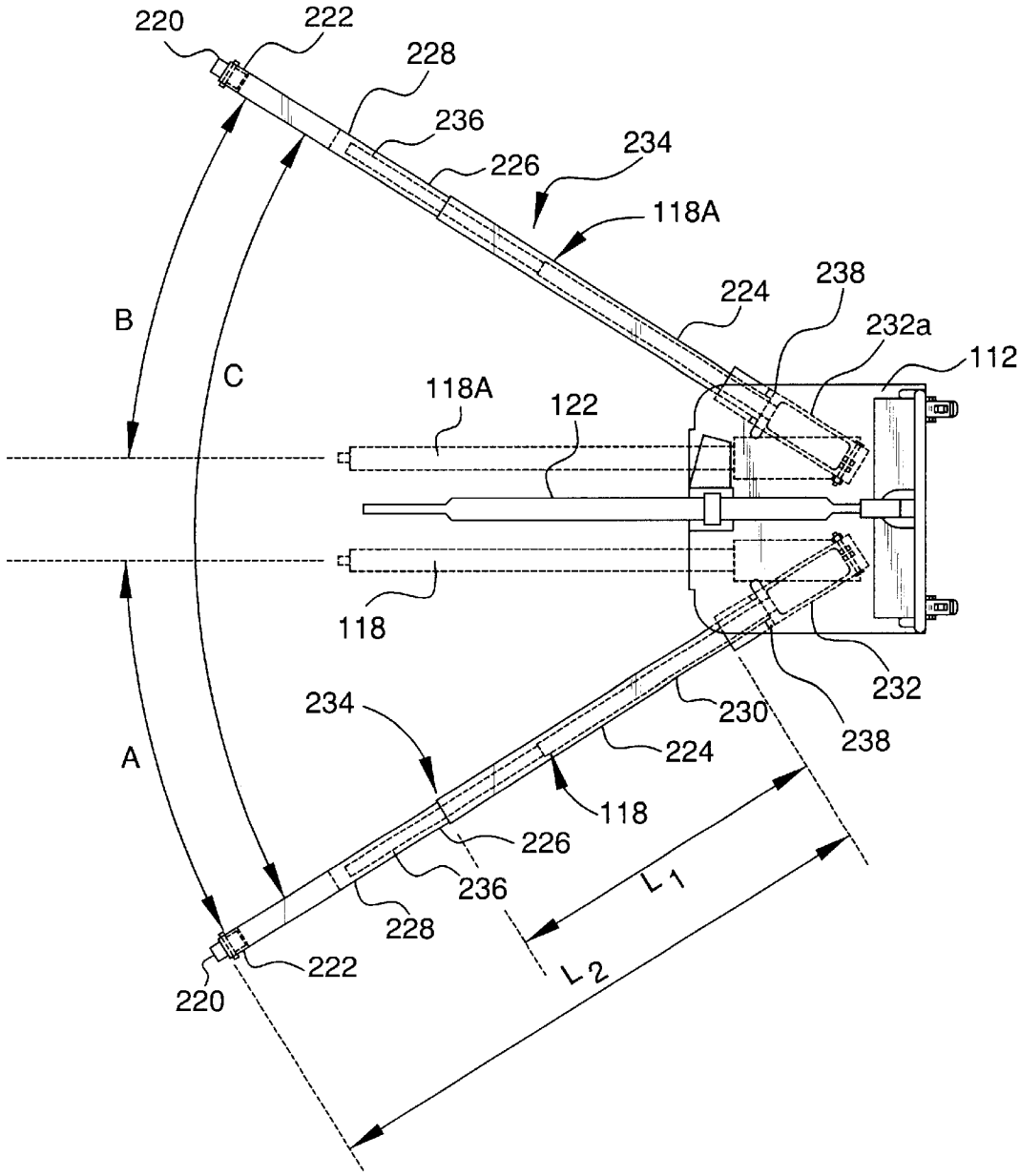
FIG. 5 is a top view of the device showing the support leg linear and divergence range of travel including, in phantom, the support legs closed and fully retracted.

Referring now to FIG. 5, the extendable legs 118 and 118*a* are shown in phantom in the stowed position, such as before deployment. Using actuator 310 of FIG. 3, the extendable legs 118, 118*a*, may be extended until each leg reaches a fully diverged and deployed state.

For example, legs 118 and 118*a* may extend together linearly, such that an angle A covers, for example, the range of 0 degrees to 45 degrees. In an embodiment, both legs 118 and 118*a* may be extended simultaneously, such that angle A is roughly equal to angle B. The total divergence of the legs 118, 118*a* may be represented as angle C, and as an exemplary embodiment, angle C may have a range of, for example, between 0 degrees and 90 degrees. Further, using actuators 232, 232*a*, both legs 118, 118*a* may be extended from length L1 to length L2. The activation of all, or a portion of, the actuators may be monitored by a programmable controller 412, such as a memory device activated switch, a programmable logic controller, or other microcontollers apparent to those skilled in the art.

Figure 6:
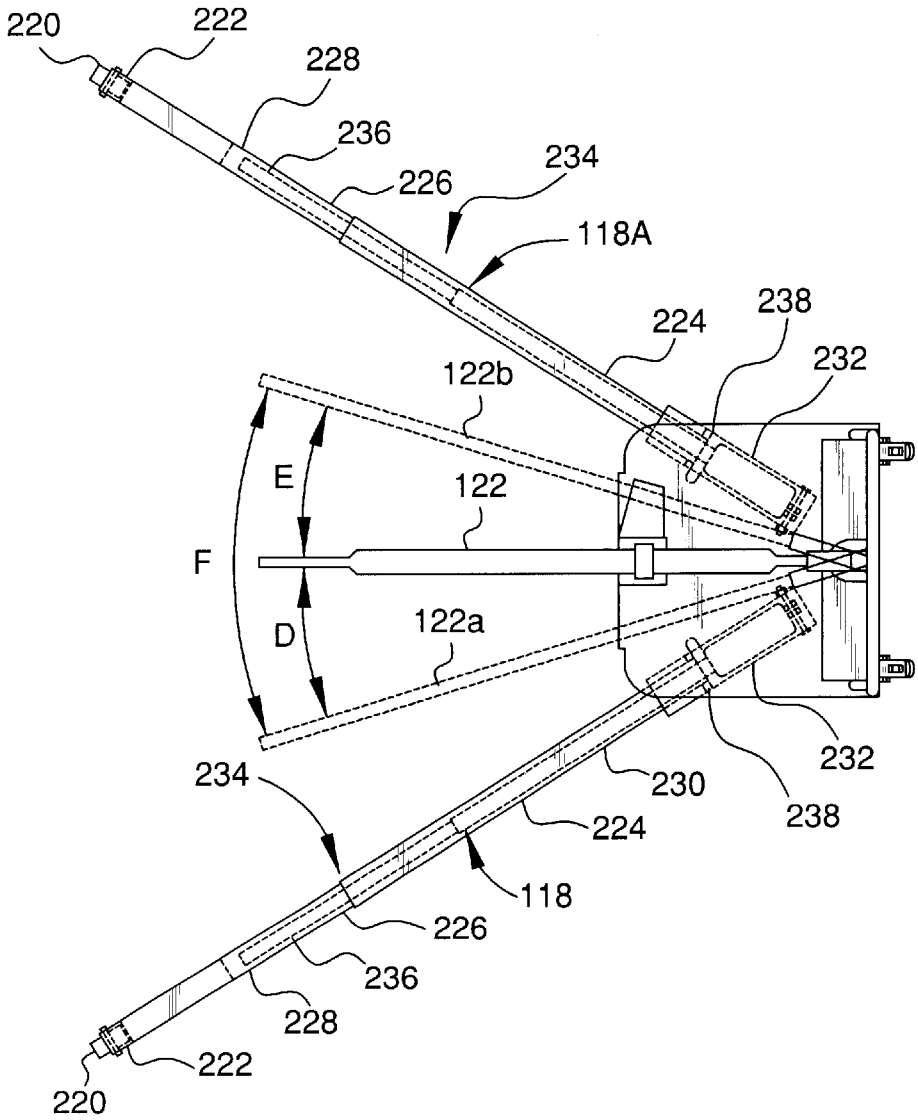
FIG. 6 is a top view of the device showing the lift arm assembly rotational range of travel.

Using actuator 316 of FIG. 3, the lift arm assembly 122 may be rotated. Referring also to FIG. 6, lift arm assembly 122 may be moved from its center position to a position indicated in phantom in FIG. 6 as 122*a*. This rotation is represented as angle D. Similarly, the lift arm assembly 122 may be rotated to a position represented in phantom in FIG. 6 as 122*b*, thus moving through angle E. The full angle of motion of lift arm assembly 122 is thus represented as angle F. In an exemplary embodiment, angle F may be, for example, a maximum of +/−60 degrees.

Safety considerations may be imposed, such that the rotation of lift arm assembly 122 through angle F may be limited so as not to allow the lifting device to tip over under load. This limiting may be performed, for example, by a limiting of actuators, dependent on predetermined criteria, such as a limiting by controller 412. For example, angle F may be so limited at a point when angle C of FIG. 5 is a predetermined minimum value, as determined by a sensing of angle C by controller 412, such as wherein the controller 416 monitors the activation of an actuator. As an additional constraint, angle F of FIG. 6 may be restricted to some minimum value if the combination of angle C is below some minimum value, and the length of extendable legs 228 is below some minimum value of L2.

In an exemplary embodiment, the rotation of lift arm assembly 122 of FIG. 6 may be limited such that a maximum value of angle F is 10 degrees (+/−5 degrees from center axis) for a divergence angle C of less than about 66 degrees, and/or for an extension length L2 of FIG. 5 of less than, for example, 95% of the full extended length L2. These restrictions may be imposed on the operation of the lifting device so as to prevent tipping. It should be noted that lift arm assembly 122 may be lowered and elevated by use of actuator 128 at any time without restriction.

In this exemplary embodiment, angle F may be controlled by an actuator having a stroke of 3.94"and this stroke may be limited to 1.91" for proper operation. Thus, full retraction of the actuator may cause an angle F of −30 degrees from center axis, and a full stroke of actuator to 1.91" may cause an angle F of +30 degrees from center axis. However, in accordance with the status of length L2, and/or the openness of the angle C, the controller 412 may limit the actuator to function, for example, over a stroke of 1.08"+0.166" right and 0.157" left, thereby limiting angle F to +/−5 degrees from center axis, wherein the controller assesses length L2 to be less than 95% of full length L2, and/or wherein the controller 412 assesses the legs to be less than 95% open.

For example, in this exemplary embodiment, the actuator that opens and closes the leg angle C may be, for example, an actuator having a total stroke of 5.91", and an install length of 12.21". Such an actuator may be fully extended when the legs are closed, and fully retracted when angle C approaches, for example, 70 degrees. Thus, the legs may be 95% open when the stroke is down from 12.21" to 0.295". The actuators that extend the legs outwardly may have a stroke of, for example, 20.67", and may be at full stroke upon full leg extension. Thus, at 19.36" stroke, the controller 412 may assess the respective leg controlled by the respective actuator as being 95% extended. Thereby, when at least one, or, for example, both, of these two 95% minimum conditions are met, angle F may be allowed, by the controller 412, to exceed +/−5 degrees from center. In this exemplary embodiment, the patient lift device may lift up to, for example, seven hundred pounds.

An additional restriction on operation to maintain operation of lift device within safe parameters may include inhibition of the retraction of the extendable legs, and/or inhibition of the closing of the angular divergence of the extendable legs, while performing a lift of a patient. Specifically, one embodiment may include the operational restriction, by the controller 412, of inhibiting and/or preventing movement of the actuators that control leg extension and/or retraction, or of the actuators that control leg divergence and/or closure when the lift arm is rotated more than 5 degrees left or right of the center location. Equivalently, this occurs when the entirety of angle D or E of the lift arm assembly exceeds 5 degrees. Correspondingly, leg extension and leg divergence actuators may be re-enabled if the lift arm assembly is rotated to be within 5 degrees left or right of the center axis.

The handheld controller 416 of FIG. 1 may be employed to provide an operational safety interlock to prevent patient lift and transfer outside of limit condition, such as the limit conditions on divergence angle and leg extension length discussed hereinabove. User control of all actuators in the lifting device may be provided by control pad 416. The safety interlock within the controller 416 may operate by tracking the operation and position of actuators, and by allowing operation of particular ones of the actuators only upon proper actuation of other actuators, for example, in accordance with information from controller 412. The control device may include therein the digital controller 412 running software that provides the limitations of movement stated hereinabove. Software resident in the controller 412 may track performance of all actuators in the lifting device, or only actuators of interest and the respective position indicators thereof, in order to ensure safe operation of the lifting device. The software, and/or the controller 412, and/or the handheld controller 416, may track proper and safe operation, such as by monitoring the output of at least one read switch engaged and aligned to monitor the position or performance of certain ones of the actuators, as discussed hereinabove. The handheld controller 416 may incorporate a keypad and may incorporate a display indicating some indicia of operation of the lifting device, such as, for example, the rotational position of the lift arm assembly, the angular displacement of the extendable legs, and the linear displacement of leg extension.

In one embodiment of the present invention, the handheld controller 416 and/or the controller 412 monitors position sensors located in the lifting device to ensure that the hereinabove safety limits are met. For example, reed, limit, magnetic, Hall effect or other proximity switches may be used to sense when the extendable legs are sufficiently diverged enough to allow safe operation. In addition to these sensors, sensors may be used to sense when the extendable legs are sufficiently deployed linearly to allow safe operation of the lifting device. Once again, sensors may be used to sense the rotational location of the lifting arm so as to prevent rotation of the lifting arm when the extendable legs are not fully deployed in at least one of either length or angular displacement.

In one embodiment, a digital position indicator may be used for the leg angular divergence, extension, and lifting arm rotation position. For example, a digital encoder may be used to indicate the actual position of the legs or lift arm assembly and make the information available to the digital controller.

In one embodiment, rotary digital encoders may be used on all rotary type actuators. In this embodiment, the digital encoders indicate the number of revolutions, for example, in degrees or binary number count, to indicate the position of screw-type rotary actuators in order to limit the overall operation of the lifting device to be within the hereinabove safety limits. In this embodiment, the controller 412 would receive digitized position information from all actuators in the lifting device and translate that information to relevant positional information to ensure operation within safe operating limits. It is well understood by those of skill in the art that the actuators may be of the rotary or linear type, and that digitized position information may be obtained via any of the commercially available digital position sensing devices, including linear and rotary encoders.

In an additional embodiment of the present invention, the handheld controller 416 and/or the controller 412 may monitor variables, such as sensors, such as weight transducers, and/or such as current drawn by an actuator, in order to monitor weight present on the hook device of the lift arm. Movement, such as retraction of legs, closure of leg divergence, or the like, may thereby be limited, as set forth hereinabove, when a patient weight is sensed on the lift arm. The weight sensing may be calibrated, such as to account for the weight present on the lift arm when no patient is on the lift arm, such as, for example, the 20–30 lbs that may be present due to certain embodiments of the hook device.

A bypass mode of operation may be implemented in the controller 416 to facilitate breakdown and setup of the lifting device. The use of the bypass mode for actuating movement beyond the hereinabove ranges constitutes a safety hazard should an operator be using the device to lift a patient. Therefore, a safety interlock may be implemented in the controller 416 to prevent inadvertent operation in the bypass mode. In one embodiment, a lockout keypad code may be entered in order to operate the unit in bypass mode. Once in bypass mode, an audible alarm may be sounded to alert or remind the operator that the unit is in bypass mode, and is to be used only for breakdown and setup of the lifting device. In this embodiment, an additional keypad input may be required to exit the bypass mode.

In one embodiment, a physical lockout key may be used to temporarily place the unit in bypass mode. Once again, upon placement into bypass mode, an audible alarm may be sounded to alert or remind the operator that the unit is in bypass mode to be used only for breakdown and setup of the lifting device. Exit from the bypass mode may be obtained by removal or reset of the physical key or key position. Those of skill in the art will realize that any form of safety interlock mechanism may be used. For example, a physical key and key position, physical or magnetic, a digital key code, or a key switch of limited access on the controller device are exemplary of such mechanisms.

In operation, it is recommended that a patient be placed upon a support sling. The lift arm is positioned above the patient and a lifting bar is properly positioned over the support sling. This configuration minimizes any swinging tendency as the support sling and patient is pulled upward. A hook for attachment to the support sling may be attached to the end of the lift arm assembly 122. While positioning the device it may be left free to roll so as to more easily align the end of the lift arm assembly above the patient. Once the device is properly located, the locking casters are engaged so as to prevent any undesirable movement during the lifting process.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and the equivalents thereof.

What is claimed is:

1. A limiter of movement of a patient lifting device, comprising:

a controller that senses:
- lateral rotation of a lifting arm of the patient lifting device for lifting at least one patient;
- linear displacement of at least two extendable support legs of the patient lifting device; and
- an angular diversion of the at least two extendable support legs;
- wherein said controller inhibits the lateral rotation of the lifting arm in accordance with the linear displacement and the angular diversion to prevent tipping said lifting device.

2. The limiter of claim 1, wherein the linear displacement is at least 95% of full extension, and wherein the angular diversion is at least 70 degrees, and wherein said controller uninhibits the lateral rotation in accordance with the linear displacement and the angular diversion.

3. The limiter of claim 1, wherein the linear displacement is less than 95% of full extension, and wherein the angular diversion is less than 70 degrees, and wherein said controller inhibits the lateral rotation to within +/−5 degrees of a center axis in accordance with the linear displacement and the angular diversion.

4. The limiter of claim 3, further comprising at least one position indicator to assess at least one of the linear displacement, the angular diversion, and the lateral rotation.

5. The limiter of claim 4, wherein the at least one position indicator is at least one selected from the group consisting of rotary digital position encoders and linear digital position indicators.

6. The limiter of claim 1, wherein said controller senses said lateral rotation of the lifting arm, said linear displacement of said extendable support legs, and said angular diversion of said support legs, by one or more selected from the group consisting of reed switches, magnetic position sensors, Hall effect position sensors and digital position indicators.

7. A computerized controller that limits the movement of a patient lifting device in a normal mode of operation to prevent tipping of said lifting device, comprising:

a mode controller, wherein said mode controller operates the patient lifting device in a bypass mode for setup and breakdown of the patient lifting device, and otherwise operates the patient lifting device in a normal mode; and a motion controller that controls movement of a lift arm of the patient lifting device in accordance with a footprint of the patient lifting device, upon activation of the normal mode by said mode controller.

8. The computerized controller of claim 7, wherein entry into the bypass mode is via one or more items of the list consisting of a keypad entry, the use of a key into the controller, and a switch on said controller.

9. The computerized controller of claim 7, further comprising an audible alarm operated in the bypass mode.

10. In a lifting device having at least two linearly extendible legs having an angular diversion therebetween, and a laterally rotating lift arm, a method of limiting movement of the lifting device, comprising:

sensing the lateral rotation of the lift arm;

sensing the linear extension of the at least two linearly extendable legs; and sensing the angular diversion of the at least two extendable legs;

inhibiting the lateral rotation of the lift arm in accordance with the linear displacement and the angular diversion sufficiently to prevent tipping of the lifting device.

* * * * *